US007401658B2

(12) United States Patent
Matsumoto et al.

(10) Patent No.: US 7,401,658 B2
(45) Date of Patent: Jul. 22, 2008

(54) BLADE FOR WORK MACHINE, AND CONSTRUCTION AND EARTH-MOVING MACHINE PROVIDED WITH THE SAME BLADE

(75) Inventors: Norihisa Matsumoto, Osaka (JP); Masatake Tamaru, Osaka (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 11/702,947

(22) Filed: Feb. 6, 2007

(65) Prior Publication Data

US 2007/0209811 A1 Sep. 13, 2007

Related U.S. Application Data

(63) Continuation-in-part of application No. 10/982,699, filed on Nov. 4, 2004, now Pat. No. 7,191,846, which is a continuation-in-part of application No. 10/480,147, filed on Dec. 8, 2003, now Pat. No. 6,938,701.

(30) Foreign Application Priority Data

Nov. 12, 2002 (WO) ..... PCT/JP02/11787

(51) Int. Cl.
*E02F 3/76* (2006.01)

(52) U.S. Cl. ..... 172/811; 37/266; D15/32

(58) Field of Classification Search ..... 172/810, 172/811, 815; 37/241, 206, 253, 266, 274; D15/10, 11, 25, 23, 32
See application file for complete search history.

(56) References Cited

U.S. PATENT DOCUMENTS

| | | | |
|---|---|---|---|
| 5,392,864 | A | 2/1995 | Lindenmuth |
| 5,620,053 | A | 4/1997 | Kamikawa et al. |
| D477,610 | S | 7/2003 | Matsumoto et al. |
| D478,098 | S | 8/2003 | Matsumoto et al. |

FOREIGN PATENT DOCUMENTS

| | | |
|---|---|---|
| CN | 2506701 | 8/2002 |
| JP | 61-76861 | 5/1986 |
| JP | 63-71253 | 5/1988 |
| JP | 04-92064 | 8/1992 |
| JP | 08-49224 | 2/1996 |
| JP | 2001-040693 | 2/2001 |

*Primary Examiner*—Christopher J. Novosad
(74) *Attorney, Agent, or Firm*—Fish & Richardson P.C.

(57) ABSTRACT

An object of the invention is to provide a blade preferable for being mounted on various kinds of work machines, particularly work machines for digging, carrying of soil and leveling, in which increase in a quantity of soil per tractional force is achieved with a simple structure to reduce consumption horsepower and increase fuel consumption efficiency thereby leading to low cost.

16 Claims, 16 Drawing Sheets

BLADE FOR WORK MACHINE, AND CONSTRUCTION AND EARTH-MOVING MACHINE PROVIDED WITH THE SAME BLADE

This is a continuation-in-part of application Ser. No. 10/982,699 filed Nov. 4, 2004, now U.S. Pat. No. 7,191,846, which is a continuation-in-part of application Ser. No. 10/480,147 filed Dec. 8, 2003, now U.S. Pat. No. 6,938,701, the entire disclosures of which are incorporated herein by reference.

TECHNICAL FIELD

This invention relates to a blade to be mounted on various kinds of work machines such as a bulldozer and a tractor shovel, and more particularly to a blade of a work machine which is optimally suitable for digging, carrying of soil and leveling, has an excellent working efficiency, and achieves improvement in fuel consumption efficiency and economic performance, and a construction and earth-moving machine provided with the same blade.

BACKGROUND ART

Various kinds of work machines such as a bulldozer and a tractor shovel have been often used in working sites for construction, civil engineering and the like. Such kind of the work machine is provided with a blade which is a working attachment. This blade is used widely for bulldozer operation such as digging, carrying of soil, banking, compacting and leveling.

To exert the maximum working efficiency on this work machine, it is important to satisfy various kinds of conditions such as increasing a quantity of soil carried per cycle as much as possible, reducing a resistance during digging/carrying of soil, and fitting to different kinds of soils. Further, ability of banking, compacting and leveling at the same time is preferable because it leads to a remarkable improvement of working efficiency. Finding out an optimum blade structure, configuration, width, height, cutting edge position, cutting angle and the like which satisfy these conditions improves the working efficiency of a work machine, reduces fuel consumption and shortens an entire working period advantageously.

As an example of a blade assembly which increases working amount for this kind of work machine, for example, Japanese Patent No. 2757135, which was proposed by this applicant previously, has been known. This patent publication has disclosed a blade assembly, in which its blade posture provided on a front portion of a large bulldozer can be controlled for each step of digging, carrying of soil, and discharge of soil. The blade assembly disclosed in the same publication controls a blade driving hydraulic system to incline backward (pitch back) the blade at a predetermined angle with respect to a posture at the time of excavation for carrying of soil and incline forward (pitch dump) at a predetermined angle with respect to a posture at the time of digging for discharging of soil.

At the time of carrying of soil, quantity of soil to be embraced within the blade is increased by tipping the blade backward at a predetermined angle with respect to the posture at the time of digging. A force for pressing the ground is generated in a front section of the vehicle by the soil embraced within the blade. The ground contact pressure distribution of tractor belts of the vehicle is equalized by this force so that an apparent vehicle weight is increased and its tractional force is transmitted effectively to the ground. Further, by embracing a large quantity of excavated soil within the blade, the weight of the excavated soil swollen ahead of a blade edge and the ground contact length of the excavated soil on the ground are decreased thereby reducing soil carrying resistance. On the other hand, by tipping forward the blade at a predetermined angle with respect to the posture at the time of digging for discharge of soil, the soil discharge operation is facilitated.

To exert working capacity of a bulldozer to its maximum extent, in terms of force balance on soil carrying operation of the bulldozer, the tractional force must be larger than the soil carrying resistance and vehicle drive force must be larger than the tractional force as described in the above-mentioned publication. According to the above publication, increase in the tractional force and decrease in the soil carrying resistance are made possible by controlling the blade posture, thereby increasing the working amount of the bulldozer. Consequently, the quantity of soil carried can be increased largely without enlarging a bulldozer size, engine output or capacity of its blade.

Most of engine output necessary for digging and carrying of soil in the bulldozer is consumed by drive force of the vehicle and tractional force for digging/carrying of soil. Thus, it is necessary to reduce loss of energy during power transmission to improve fuel consumption efficiency.

Further, the resistance of the blade during digging/carrying of soil needs to be reduced thereby improving the fuel consumption efficiency. Generally, a medium size or small size bulldozer has a shorter soil carrying distance than a large size bulldozer. Thus, the quantity of soil carried is difficult to be increased only by reducing the soil carrying resistance with the art disclosed in the above publication.

If these demands are met, the engine output can be used effectively during digging/carrying of soil even by a blade having the same capacity or the same tractional force as a conventional example.

Because, particularly the medium or small bulldozer is designed to be as compact as possible, its blade is designed with a smaller size as compared to a large bulldozer. The blade assembly disclosed in the above publication is used for the large bulldozer and an extra blade driving hydraulic unit or its attachment needs to be incorporated. Therefore, not only a structure of the entire blade assembly is enlarged but also a number of components is increased, so that a mechanism becomes complicated. Even if it is intended to load the above-described blade assembly on the medium or small bulldozer just as it is, a sufficient installation space for disposing an extremely complicated mechanism is difficult to secure and therefore, the design on the vehicle needs to be changed largely, thereby leading to a large increase in sales price.

On the other hand, according to a blade structure disclosed in Japanese Utility Model Application Laid-Open No. 61-76861, a first blade member is mounted on a front section of a bottom end of a backhoe body and second blade members are mounted on both right and left ends of the first blade member through mounting bolts such that they can be moved to obliquely forward or obliquely backward thereof. According to a blade structure disclosed in Japanese Utility Model Application Laid-Open No. 63-71253, a pair of first blade members for right and left sides are mounted on a front section of a bottom end of a ring mounting type loader through hinges such that they can be swiveled to opposite directions to each other around a vertical axis while a second blade member is mounted on a top edge of each first blade member through hinges such that it can be fallen thereon. Further, according to a blade structure disclosed in the Japanese Utility Model Application Laid-Open No. 4-92064 proposed by the same applicant as the invention, a first blade member is mounted on a front section of a bottom end of an earth-moving machine while a second blade member is protruded from each of right and left end sections of the first blade member such that it is bent forward. Furthermore, Japanese Patent No. 2001-40693 has disclosed a blade structure in which an inclined face for discharging soil and sand remaining on a back face of the blade at the time of leveling work by traveling backward is formed.

The blades disclosed in these publications are called straight dozer, V-dozer, inverted V dozer, U dozer or the like. Those blade faces are produced into various configurations such as an arc face having a certain curvature or a curved face having different curvatures on its upper and lower sections. However, they are not intended clearly for reducing consumption horsepower per tractional force on digging/carrying of soil and increasing power consumption efficiency. As described above, prior arts did not propose any blade which realized effective usage of energy during digging/carrying of soil and low fuel consumption.

Therefore, an object which the invention intends to solve is to provide a blade which is mounted on various kinds of work machines, capable of reducing power consumption due to increase in the quantity of soil per tractional force with a simple structure, realizing low cost by intensifying fuel consumption efficiency, and applicable to work machines for digging, carrying of soil, banking, compacting, leveling and the like.

DISCLOSURE OF INVENTION

The basic structure of the invention for solving the problem is a blade to be mounted on various kinds of work machines, a blade comprising a central front face section and end front face sections disposed at right and left thereof via jointed front face sections such that they are retracted, in which a first cutting edge is provided at a bottom end of the central front face section, the first cutting edge being extended in a perpendicular direction with respect to a digging direction.

Work machines which can be applied to the invention include, for example, construction and earth-moving machines, and as typical construction and earth-moving machines, a bulldozer, a backhoe, a motor grader and the like can be mentioned.

The blade of the invention is the same as a conventional blade in that it has a central front face section constituting part of a blade front face and right and left end front face sections extended at right and left side ends such that they are expanded forward. However, the blade of the invention is different largely from the conventional blade in that the end front face sections are disposed backward of the central front face section via the jointed front face sections disposed continuously on the right and left ends of the central front face section, or that intersection positions of the jointed front face sections and the end front face sections are located backward with respect to an extension of a bottom end of the central front face section.

A first characteristic feature of the blade of the invention is that a first cutting edge is disposed so as to be on an equal level or protruded forward with respect to front ends of cutting edges of the end front face sections. By adopting this construction, the first cutting edge is generally capable of cutting and breaking up soil and sand positively ahead of the cutting edges disposed on bottom ends of the end front face sections. On the other hand, because the first cutting edge cuts ahead, the substantial digging force of third cutting edges of the end front face sections become smaller than the digging force of the first cutting edge. Thus, as compared to a conventional case, the tractional force applied on the cutting edges of the end front face sections is relaxed so that such resistance forces as digging resistance and soil carrying resistance act upon the first cutting edge and the cutting edges of the end front face sections substantially equally, and the tractional force acts on both the first cutting edge and the cutting edges of the end front face sections effectively. Consequently, soil dug by the cutting edges of the end front face sections and soil dug by the first cutting edge converge smoothly. Even if the front ends of the third cutting edges are slightly protruded forward relative to the first cutting edge, since protruded amounts are small and they are only part of the front ends of the third cutting edges, an above-mentioned function is not lost in essence.

A second characteristic feature of the blade of the invention is that intersection positions of bottom ends of the jointed front face sections and bottom ends of the end front face sections are disposed backward relative to the central front face section. With this feature, the blade is provided with a function of holding soil being dug or carried and preventing soil from drifting out from sides of the blade. Especially, the jointed front face sections have a function of smoothly converging soils moved from the end front end face sections and central front face section at a time of digging and carrying of soil, swelling and embracing soil along each blade front face of the jointed front face sections and the end front face sections. As a consequence, loss in a quantity of soil is reduced and further, resistance of soil trying to flow into the central front face section from the end front face sections is reduced, thereby largely increasing a quantity of soil deposited on the blade front face of the central front face section, as mentioned above.

Due to synergistic action of these, the resistance force is reduced so that the quantity of soil per tractional force can be increased. Moreover, horsepower consumption during digging and carrying of soil can be reduced largely and the maximum digging amount and soil carrying amount are secured with the minimum energy in a short time. Consequently, fuel consumption efficiency of the work machine is improved remarkably thereby reduction in cost per earthwork unit being achieved.

An apparent shape of soil carried by the blade of the invention is a shape swelling forward exceeding an angle of repose at a central section from its top end to the bottom end of the central front face section. On the other hand, an apparent shape of soil carried by the conventional blade is a linear and flat shape having an inclination substantially equal to the angle of repose from its top end to a bottom end of the blade.

In the meantime, although it is not a blade applicable to various kinds of work including digging, carrying of soil and leveling like the invention, WO93/22512 has disclosed a blade having a configuration similar to the blade of the invention. The blade described in this publication is a type applied to a landfill compacting vehicle which compacts refuse or trash while spreading, used at a refuse disposal site or the like. The blade comprises end blade sections which are extended like wings such that they are protruded in a vehicle traveling direction from right and left ends, a central blade section which is a single plate for connecting both the right and left end blade sections, and a protruded section which is inclined downward from halfway of the central blade in a vertical direction and protruded in the vehicle traveling direction. When a bottom face of the protruded section is placed along a vehicle traveling surface, bottom edges of the end blade sections and central blade section are also placed along the vehicle traveling surface.

Steel wheels are adopted as traveling units of the compacting vehicle to compact refuse or trash. It is assumed that a posture when the bottom edges of the end blade sections and central blade section of the aforementioned blade are matched with the traveling surface of the wheels linearly is a first position, and that a posture when the blade is lifted up and tilted forward is a second position. When the blade is located at the first position, refuse and soil are scattered horizontally by traveling of the compacting vehicle and when the blade is located at the second position, quantities of refuse and soil transferred into a space between right and left wheels by the protruded section in the center of the blade are controlled, that is, height of refuse transferred into the space is controlled, so that the quantities of refuse and soil to be sent into a compacting area by the wheels through a gap between the bottom edges of the end blade sections and central blade section and the traveling surface are controlled.

The blade disclosed in this publication has been developed in taking account of a function of diffusing refuse and the like, and a function of controlling the amount of refuse which goes into the space formed between right and left wheels acting as a compressing member in order to prevent an excessive amount of refuse from invading into the space and damaging a bottom face of the vehicle as well as controlling processing amount of refuse and the like to be compressed. If the blade shape of the invention which is functionally different is compared with the blade disclosed in this publication, they are considerably different in following points.

That is, (1) although the central front face section of the blade of the invention is formed continuously from the top end to the bottom end in the center thereof in order to hold a large amount of dug soil and sand, the central protruded portion on the blade of the publication corresponding to this central front face section is protruded from halfway between the top and bottom ends up to the bottom end in the central blade section mainly to expel excessive refuse, and (2) although a pair of each of the jointed front face sections and end front face sections on the right and left sides of the invention are disposed rearward of the central front face section in their top view, the front end position of the end blades in pair on the right and left sides protruded forward from the central blade section of the publication is disposed forward of the protruded bottom edge of the central protruded portion, which is not recited in the specification, but shown in all drawings. These different points originate from that, as described previously, the blade of the invention and the blade disclosed in the publication have different functions.

According to the invention, blade width at the bottom end of the central front face section is preferred to be set larger than internal width between right and left traveling units. This is the minimum width for leveling the ground without any traveling wheel traces of running members in case of executing leveling work by forward traveling. Particularly if the width of the front face in the center of the blade at the bottom end of the central front face section is set substantially equal to gauge width which is a distance between centers of the right and left traveling units, the most excellent balance is obtained in terms of the functions of digging, carrying of soil and leveling.

Generally, major work of the above-described work machine include digging, carrying of soil and leveling, it is important to provide with a blade which satisfies these work at the same time. The blade of the invention has the function of leveling as well as digging and carrying of soil.

Usually, for this kind of leveling work, two types of work, that is, leveling the ground while digging, carrying of soil and filling dented places, and leveling uniformly are required. According to the invention, if the width of the blade of the central front face section is set larger, the so-called leveling function is intensified. On the other hand, according to the invention, the central front face section is protruded forward of intersection points of the jointed front face sections and end front face sections on the right and left sides in their top view. Although the jointed front face sections and end front face sections of the invention are provided with the leveling function, the function mostly depends on the central front face section. Thus, also in case of the invention, the blade width on the central front face section can be increased.

However, an important point of the invention is that because the first cutting edge is disposed such that it is protruded forward of the front ends of the cutting edges of the end front face sections, the first cutting edge cuts soil and sand positively ahead of the cutting edges disposed on the bottom ends of the end front face sections so that soil dug by the cutting edges of the end front face sections and soil cut by the first cutting edge are joined together smoothly thereby increasing the quantity of soil carried. Thus, according to the invention, as the blade width of the central front face section is increased, the width occupied by the jointed front face sections and end front face sections in the top view needs to be decreased.

To decrease the width occupied by the jointed front face sections and end front face sections and to reduce resistance forces of digging resistance and soil carrying resistance to increase the quantity of soil carried largely, preferably, length along the bottom ends of the jointed front face sections and end front face sections is set constant. That is, to increase the blade width of the central front face section and to secure a predetermined length along the bottom ends of the jointed front face sections and end front face sections, an angle of bending at each of the intersection points of the jointed front face sections and the end front face sections located backward with respect to the digging direction of the central front face section in the top view needs to be set small. As a result, necessarily, a distance between the cutting edge position on the central front face section and a supporting point of a straight frame for supporting the blade needs to be increased.

If the distance between the cutting edge position on the central front face section and the supporting point of the straight frame for supporting the blade is increased, an influence of unevenness of a ground surface is likely to be received at the time of digging, so that the vehicle becomes likely to suffer pitching in its back and forth direction. Consequently, the blade swings largely in upward and downward directions and a stabilized digging by the central front face section is disabled so that a path face is likely to be uneven thereby making it impossible to level the ground uniformly. Therefore, the blade width of the central front face section needs to be determined by taking into account the blade width of each of the jointed front face sections and end front face sections. According to the invention, by setting the blade width of the central front face section substantially equal to the gauge width which is a distance between the centers of right and left traveling units, effective digging force per width of the first cutting edge of the central front face section is increased, so that effective digging and carrying of soil are enabled and at the same time, uniform leveling is also enabled.

On the other hand, if looking at the above-mentioned blade internationally disclosed, it is understood that its structure is different from that of the invention in this point. That is, in the blade disclosed in the above-mentioned publication, effective width of the central protruded portion is set substantially equal to a distance between the right and left wheels acting as compacting units, in other words a distance between opposing faces of the right and left wheels. This is because the function of the central protruded portion lies in preventing a large amount of refuse from intruding into a vacancy between right and left wheels.

According to a preferred embodiment of the invention, the right and left jointed front face sections are disposed continuously from the central front face section such that they are expanded backward at a predetermined angle and a second cutting edge is provided at each of the bottom ends thereof. The right and left end front face sections are disposed continuously with the jointed front face sections such that they are expanded forward at a predetermined angle and a third cutting edge is provided at each of the bottom ends thereof. This point is also different from the blade disclosed in the aforementioned publication.

In the blade of the invention, the first to third cutting edges are provided at the bottom ends of the central front face section, jointed front face sections and end front face sections continuously. The first cutting edge of the central front face section is extended in a perpendicular direction with respect to the digging direction while it is on an equal level or protruded forward with respect to positions of the front ends of the third cutting edges of the end front face sections. Thus, the first cutting edge is provided with the function of substantially digging ahead and the second and third cutting edges are also provided with the function of digging by every small amount.

The second and third cutting edges are preferred to be continuously disposed in a V shape or U shape. If the second and third cutting edges are jointed in a V shape when cohesion of soil is high, dug soil likely adheres to a changeover section between the jointed front face section and the end front face section such that it becomes lump. Thus, that changeover region is desired to be formed into a curved face, for example, in a U shape. Preferably, the jointed front face sections and end front face sections are continuously in a V shape or U shape like the second and third cutting edges.

By the way, this kind of a self-propelled type work machine is often provided with an engine compartment in a center of its front section of the vehicle body and an operator operates various operation levers sitting behind the engine compartment. Thus, a field of vision of the operator is blocked by the engine compartment such that the quantity of soil deposited on the central front face section cannot be recognized directly with eyes of the operator.

When the ends of the cutting edges of the central front face section, right and left jointed front face sections and right and left end front face sections are disposed on the same line with the blade set in a posture of exerting the maximum digging performance, usually, the blade in contact with the ground surface at a cutting angle, as seen in a front view, just the quantity of soil deposited between the jointed front face sections and the end front face sections can be recognized. However, the quantity of soil deposited on the central front face section is increased because soil deposited between the jointed front face sections and the end front face sections are added. Therefore, when the operator is able to recognize the soil deposited between the jointed front face sections and the end front face sections obliquely from above, the quantity of soil deposited on the central front face section often exceeds a predetermined quantity, intensifying complexity in blade operation.

Thus, according to the preferred embodiment of the invention, the right and left second cutting edges are inclined slightly downward with respect to the first cutting edge, and the third cutting edges are inclined slightly upward with respect to the second cutting edges with the blade set in a posture for exerting the maximum digging performance, usually, the blade in contact with the ground surface at a cutting angle as seen in a front view.

Furthermore, in a case that a bottom end of each intersection portion of the second cutting edges and the third cutting edges protrudes below an extension of the first cutting edge in a front view, the changeover section between the second cutting edge and the third cutting edge cuts down the ground with its ordinary posture and at the time of digging, a digging amount larger than that by a conventional blade is obtained between the second cutting edge and the third cutting edge. Consequently, the quantity of soil deposited between the jointed front face sections and the end front face sections is increased thereby following up the quantity of soil deposited on the central front face section. As a result, even if the operator cannot recognize the quantity of soil deposited on the central front face section with eyes, he or she can know the quantity of soil deposited on the central front face section by checking the quantity of soil deposited between the jointed front face sections and the end front face sections on the right and left sides, thereby smooth blade operation being attained.

Although a layout of the right and left jointed front face sections and end front face sections is set as mentioned above, the invention naturally include a case in which, for example, the bottom ends of the first to third cutting edges are disposed on a straight line in a front view of the blade.

Further, according to the invention, preferably, at least the blade front face of the central front face section is formed of a curved face continuously in upward and downward directions thereof while blade width of the blade front face gradually increases from a bottom end toward a top end thereof. If the blade width of the blade front face is gradually increased from the bottom end toward the top end during digging, a capacity of the central blade front face section from the bottom end toward the top end is gradually increased. Consequently, soil pushed up from the bottom ends toward the top end of the blade including the jointed front face sections and the end front face sections can be smoothly moved upward and soil deposited on the blade can be largely increased at the same time. Because a large quantity of soil can be loaded on the front face of each of the blade front face sections, an excellent balance on ground contact pressure between front and rear sections of a vehicle body is obtained and further, power loss such as track shoe slip is minimized, thereby a high tractional force being obtained. Furthermore, soil deposited on the blade front face of each of the blade front face sections can be prevented from falling beyond a top end of each of the front face sections. At least, the blade front face of the central front face section is set to a curved face in which the quantity of soil to be embraced or involved is not limited. The curved face is preferred to be in a concave shape having equal curvature and further, the blade front face of each of the jointed front face sections and end front face sections is preferred to be formed of the curved face having equal curvature.

Although the central front face section, the jointed front face sections and the end front face sections can be formed separately and then welded together to form the blade of the invention, the respective front face sections may be formed integrally by casting or the like if a size, thickness and the like of the blade are set appropriately. Further, the invention comprises a supporting body for supporting rear faces of the central front face section, the jointed front face sections and the end front face sections, and right and left side sections of the supporting body are extended in an digging direction beyond the right or left side edge of the end front face sections.

The blade of the invention is supported firmly by a front edge on an opening side of the supporting body. A rear face opposite to the front edge of the supporting body is supported in the traveling direction of the vehicle through a frame, an arm or the like of the work machine. Right and left side sections of the supporting body have a function as a side plate for reinforcing the end front face sections. With such a configuration, strength and stiffness can be intensified, so that a simple structure can reinforce effectively the function of the end front face sections for holding soil being dug or carried securely.

According to the invention, preferably, width of the cutting edge at the bottom end of each of the end front face sections is smaller than that of the cutting edge at the bottom end of the central front face section and further smaller than that of the cutting edge of each of the jointed front face sections. By setting the width of each front face section to the above-described relation in dimension, the quantity of soil to be swollen and embraced along the respective blade front faces of the jointed front face section and end front face section can be reduced, thereby decreasing resistance of soil to the central front face section.

If the width of the jointed front face section is larger than the width of the end front face section, the resistance of soil flowing from the end front face section into the jointed front face section during digging or carrying of soil is decreased, so that preferably, the quantity of soil deposited on the blade front face of the central front face section is increased.

According to the invention, respective blade front faces of the central front face section, the jointed front face section and the end front face section are inclined equally or more backward with respect to front faces of the respective cutting edges. In any event, if the entire blade is inclined backward as described above, ground contact length of soil deposited on the ground surface can be reduced assuming that an inclination angle of deposited soil embraced by the blade, namely, an angle of repose is constant, and consequently, a large amount of soil can be loaded on the blade front face. As a result, soil carrying resistance can be reduced largely, and thus consumption horsepower per tractional force can be reduced to a large extent, thereby securing an excellent low fuel consumption performance. Preferably, a sweepback angle, which is a difference between an angle made by the front face of each cutting edge and the ground and an angle made by blade bottom end face of each front face section and the ground, is set to 15° or less. If the sweepback angle is set to 15° or more, the quantity of soil falling from an rear end of the blade is reduced.

According to the invention, an intersection angle between extensions of the cutting edges of the central front face section and end front face section is set to 25° or less. Preferably, this is set to a range of 15 to 20°. If this intersection angle is 25° or less, an optimum quantity of soil to be loaded on the blade front face of each of the jointed front face section and end front face section can be secured, thereby decreasing the resistance of soil being moved from the end front face section toward the jointed front face section.

Moreover, according to the invention, a blade tip angle made by the front face and the ground when each cutting edge exists on the ground surface is preferred to be 35° or more. Consequently, the minimum digging/carrying energy amount and the maximum quantity of soil are obtained.

BEST MODE FOR CARRYING OUT THE INVENTION

Figure 1:
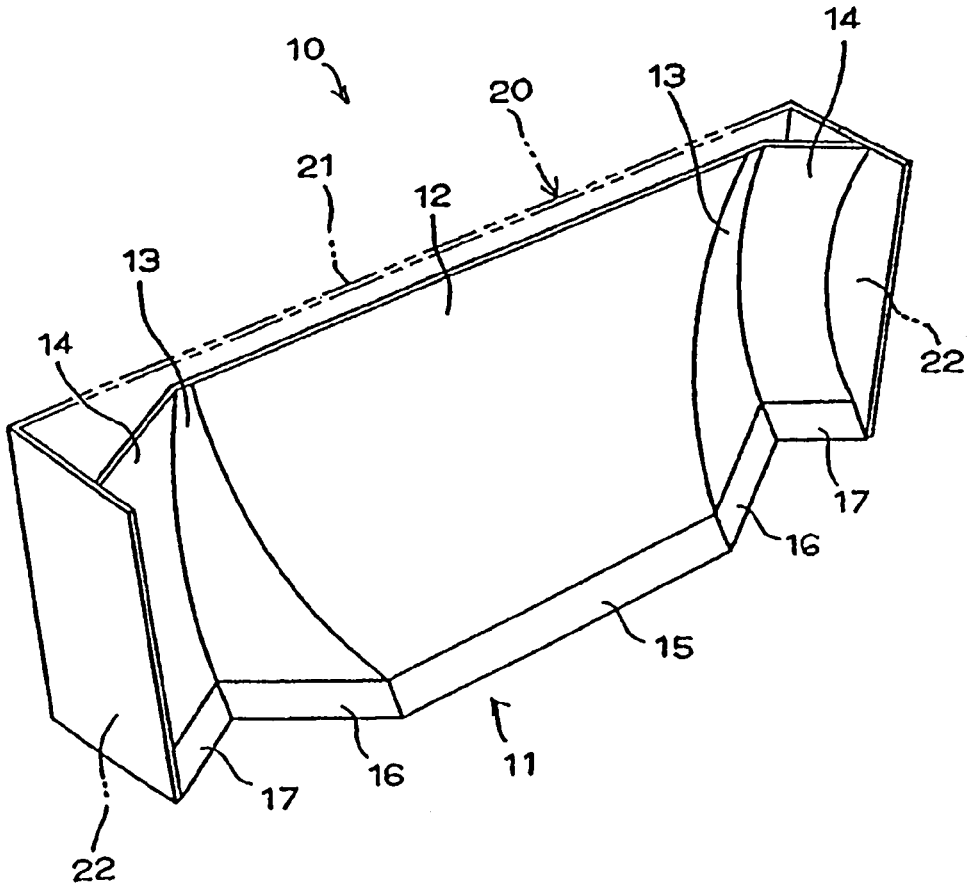
FIG. 1 is a perspective view showing an example of a schematic configuration of a typical blade which is applied to the invention.

Hereinafter, a preferred embodiment of the invention will be described in detail with reference to the accompanying drawings. A blade of the invention can be used as a working attachment which is loaded on various kinds of work machines. As the work machines applicable to the invention, for example, construction and earth-moving machines can be mentioned. Although this embodiment will be described by exemplifying a bulldozer (not shown) as a construction/earth-moving machine, the invention is not restricted to this example, but construction/earth-moving vehicles such as a shovel, backhoe, and motor grader are included.

The blade 10 according to a typical structure example of the invention is provided with a curved blade front face section 11 which is curved in upward and downward directions as shown in FIGS. 1 to 7. The front face section 11 of the blade is made of a laterally long steel material having a high stiffness and the periphery thereof is integrated with a supporting body 20 made of the same material by welding. This blade front face section 11 is comprised of a central front face section 12 having a linear first cutting edge 15 at a bottom end thereof, a pair of right and left jointed front face sections 13 each having a second cutting edge 16 which continues from the first cutting edge 15 and expand rearward at a predetermined angle, and a pair of right and left end front face sections 14 each having a third linear cutting edge 17 which continues from the second cutting edge 16 and expand forward at a predetermined angle.

Figure 2:
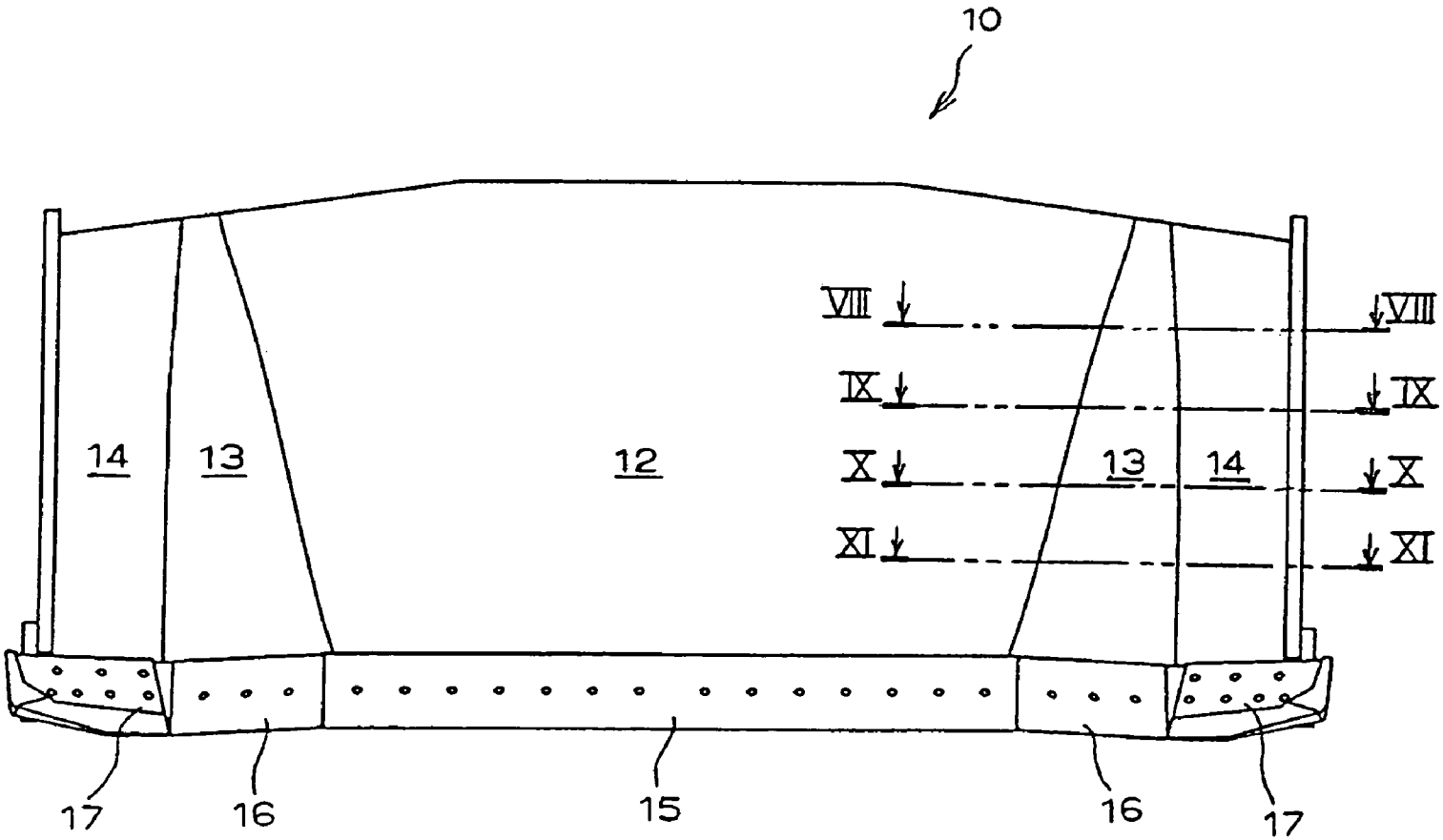
FIG. 2 is a front view of the aforementioned blade.
Figure 3:
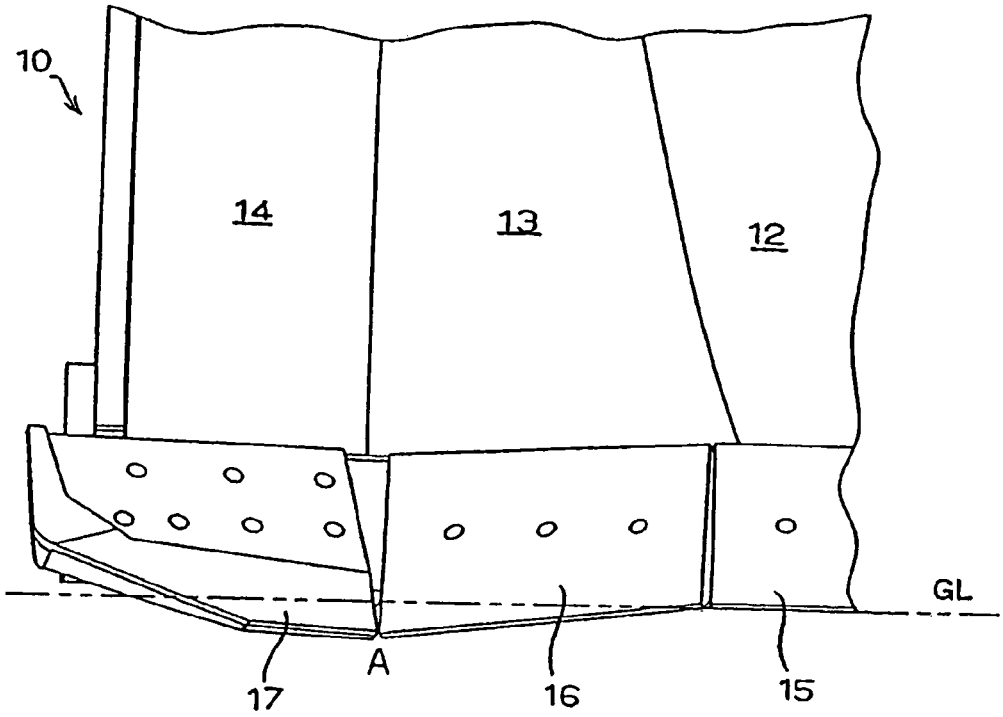
FIG. 3 is an enlarged front view showing end sections of cutting edges of the blade.
Figure 5:
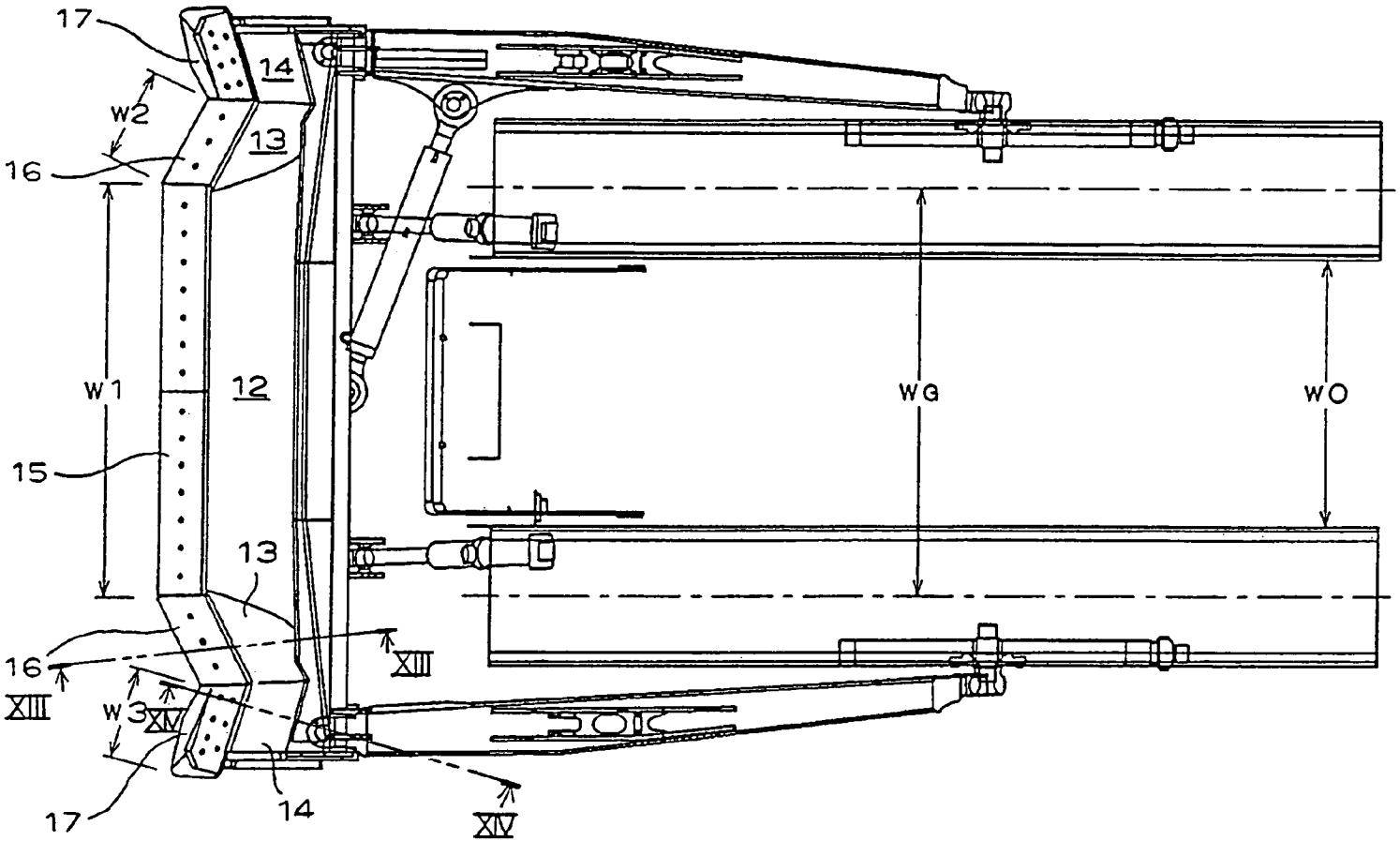
FIG. 5 is a top view showing a structure of major components of the work machine.

Part of a major feature of the invention is that as shown in FIGS. 1 and 5, the central front face section 12 is expanded forward relative to a front end position of the third cutting edge 17 of each of the end front face sections 14. However, according to the invention, due to designing circumstances, the front end position of the third cutting edge 17 of each of the end front face sections 14 may be disposed adjacent to an extension of the first cutting edge 15 of the central front face section 12. As shown in FIGS. 2 and 3, the central front face section 12 is formed such that it gradually narrows from a top to a bottom thereof. A bottom end section of this central front face section 12 has blade width having a digging function, soil carrying function and a sufficient leveling function. The first cutting edge 15 mounted along the bottom end of this central front face section 12 has a flat linear shape, which allows the blade 10 to be used effectively for digging, carrying of soil and leveling work without any replacement for each work for digging, carrying of soil and leveling.

Figure 4:
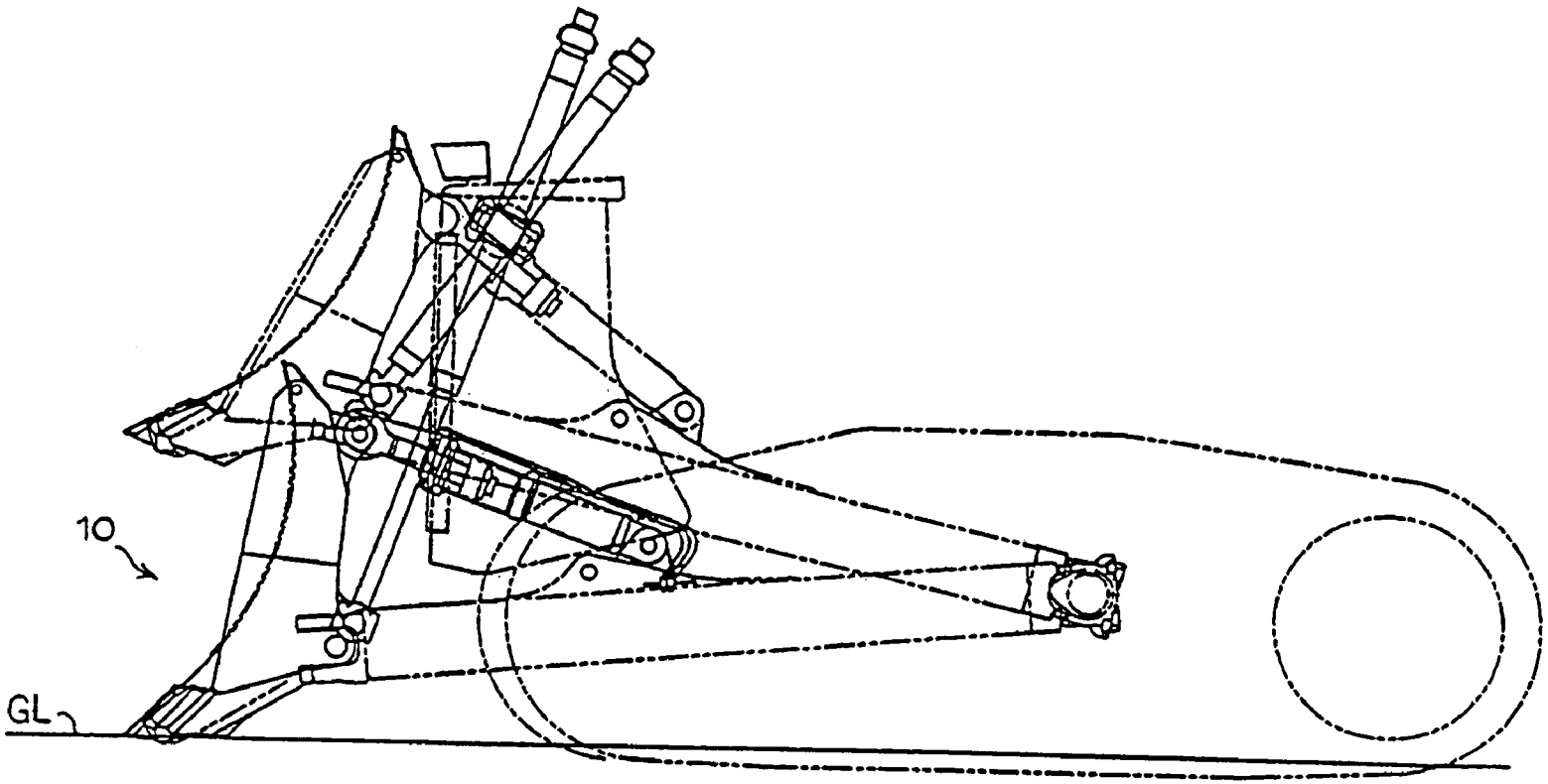
FIG. 4 is a side view showing an entire work machine for explaining lift up/down operations of the blade.

In a front view shown in FIG. 2, a side edge of each of the jointed front face sections 13 is extended obliquely in the same direction as a side edge of the central front face section 12 and the jointed front face section 13 is formed such that it gradually expands from a top end to a bottom thereof. Each of the end front face sections 14 is formed in same width from a top end to a bottom thereof. These jointed front face sections 13 and the end front face sections 14 are joined in a V shape which is expanded largely in right and left directions as shown in FIGS. 8 to 11. Although the example indicates the V shape, the invention is not restricted to this shape, but for example, it may be in a U shape, in which an opening end thereof is open largely. The front view mentioned here refers to a front view when the cutting edge is in contact with the ground with its cutting angle $\alpha$ at an angle providing the highest digging efficiency as shown in FIG. 4.

The jointed front face section 13 has a function of smoothly converging soils moved from both sides of the central front face section 12 and end front end face 14 at the time of digging and carrying of soil. The end front face section 14 has a function of holding soil being dug or carried and preventing it from drifting off the sides of the blade. Because the jointed front face section 13 and the end front face section 14 swell soil along each blade front face and embrace it, loss in a quantity of soil is reduced and further, resistance of soil trying to flow into the central front face section 12 from the end front face sections 14 is reduced, thereby increasing a quantity of soil deposited on the blade front face of the central front face section 12.

The first cutting edge 15, second cutting edge 16 and third cutting edge 17 are formed of rigid material having an excellent wear resistance and hard to destroy, for example, boron steel. The above-described arrangement of the first cutting edge 15, second cutting edge 16 and third cutting edge 17 makes the first cutting edge 15 dig ahead of the second and third cutting edges 16 and 17. Because the digging by the first cutting edge 15 collapses a surrounding ground ahead of them, a digging force substantially necessary for the second and third cutting edges 16 and 17 is made smaller than the digging force of the first cutting edge 15 and the amount of the digging thereby is smaller than that by the first cutting edge 15.

According to this embodiment, blade width W1 of the central front face section 12 is set substantially equal to gauge width WG which is a distance between centers of traveling units such as right and left crawler belts or wheels as shown in FIG. 5. The blade 10 of this embodiment has the functions of leveling as well as digging/carrying of soil. Generally, if the blade width W1 of the central front face section 12 is increased, the so-called leveling function is intensified. On the other hand, in a top face view of the blade 10, the central front face section 12 is protruded forward with respect to the jointed front face section 13 and the end front face section 14. Although bottom ends of the jointed front face section 13 and end front face section 14 have the leveling function, most of the function is born by the central front face section 12. Thus, to enlarge the leveling function, it is desirable to expand the blade width W1 of the central front face section 12. Because at least the ground between the right and left traveling units needs to be leveled during the leveling work by forward traveling, the blade width W1 of the central front face section 12 is desired to be larger than an internal width W0 between the right and left traveling units.

However, to enable a stabilized digging by the central front face section and level the ground uniformly by avoiding a pitching motion of a vehicle due to influences of an uneven surface of the ground at the time of digging as described previously, it is necessary to consider the blade width W1 of the central front face section 12 as well as the blade widths W2, W3 of the jointed front face section 13 and the end front face section 14 in their top view. If the blade width W1 of the central front face section 12 is set substantially equal to the gauge width WG which is a distance between the centers of the right and left traveling units, the effective digging force of the first cutting edge 15 of the central front face section 12 is intensified, so that effective digging and carrying of soil as well as uniform leveling are enabled.

According to this embodiment, as for the respective cutting edges 15 to 17, in a front view when, as shown in FIGS. 2 and 3, the blade 10 is set on the ground at the cutting angle $\alpha$ (see FIG. 12) which is the most effective angle, the second cutting edge is inclined downward at a slight angle with respect to right and left extensions of a blade tip of the first cutting edge 15 while the third cutting edge 17 is inclined upward at a slight angle with respect to each of the right and left extensions of the blade tip of the first cutting edge 15. That is, as shown in FIG. 3 by enlargement, when the blade tip of the first cutting edge 15 is in contact with the ground level GL, an intersection point A between the second cutting edge 16 and the third cutting edge 17 is located in the ground, slightly downward to the ground level GL. According to this embodiment, the cutting angle $\alpha$ is set to 46° and the distance between the ground level GL and the intersection point A is set to 24 mm. Of course, the cutting angle and the distance between the ground level GL and the intersection point A are changed depending on the type of the work machine and therefore cannot be uniformly determined.

If an arrangement of the jointed front face section 13 and the end front face section 14 relative to the central front face section 12 is set as described above, the intersection point A between the second cutting edge 16 and the third cutting edge 17 sink into the ground in normal digging posture. Therefore, different from a case where, for example, the bottom ends of the first to third cutting edges 15 to 17 are disposed in line at the time of digging, a replenishment digging which increases an digging amount in an area between the second cutting edge 16 and third cutting edge 17 can be realized. Due to this replenishment digging, the quantity of soil deposited between the jointed front face section 13 and the end front face section 14 is increased, and following the amount of deposited soil on the central front face section 12, soil is swollen upward between the jointed front face section 13 and the end front face section 14. Thus, even when an operator cannot see the amount of soil deposited on the central front face section 12 because it is obstructed by an engine compartment in front of the operator, the operator can confirm an appropriate amount of soil deposited on the central front face section 12 by seeing the amount of soil deposited between the right and left jointed front face sections 13 and end front face sections 14 and thus can operate the blade smoothly.

Although, according to this embodiment, the arrangement of the jointed front face sections 13 and end front face sections 14 on the right and left sides is set up as described previously, the invention is not restricted to the same arrangement, but naturally, a case where the bottom ends of the first to third cutting edges 15 to 17 are disposed in line in a front view of the blade 11 is included. This embodiment exemplifies a case where the respective front face sections 12 to 14 are formed separately and combined by welding the respective front face sections 12 to 14 together so as to form the blade front face section 11. However, the invention is not restricted to this example but naturally, a blade front face section in which the respective front face sections are integrally formed by, for example, casting is included. The blade front face section can be formed integrally by setting appropriate size, thickness and the like.

Figure 6:
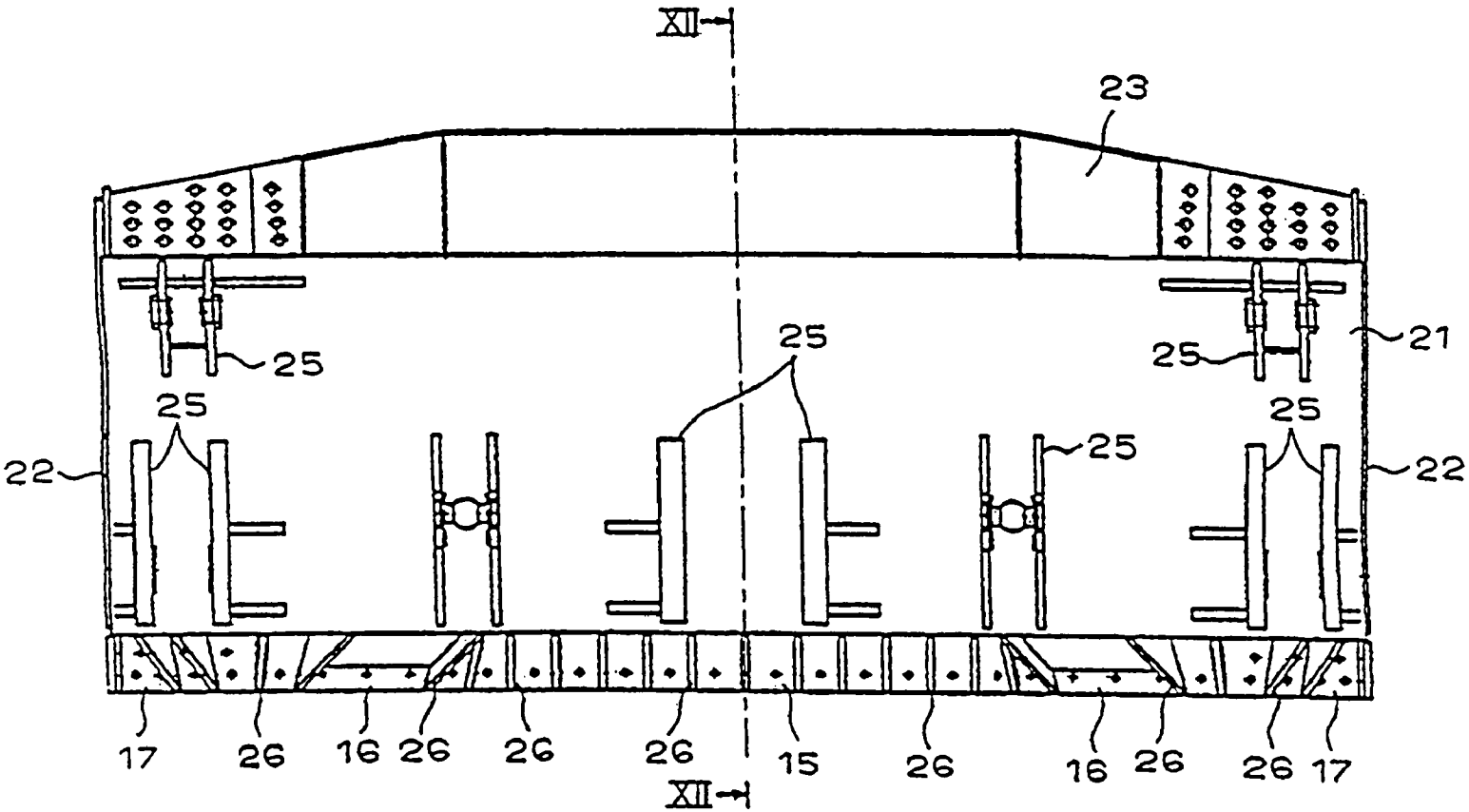
FIG. 6 is a rear view of the blade.

The blade front face section 11 is supported rigidly by a supporting body 20 as shown in FIGS. 1 and 6. This supporting body 20 is a case having an opening forward, and a laterally long rectangular rear face plate 21, a pair of vertically long rectangular side plates 22, 22 on right and left sides thereof, and upper and lower plates 23, 24, which have a configuration meeting a shape of a top edge of the blade front face section 11, located at a front end edge are welded together. As shown in FIGS. 4 to 7, plural mounting flanges 25, . . . 25 are provided protrudedly on the rear face plate 21 to mount on front sections of a bulldozer through a lift frame, brace, arms, tilt cylinders and lift cylinders such that they are protruded backward.

Figure 7:
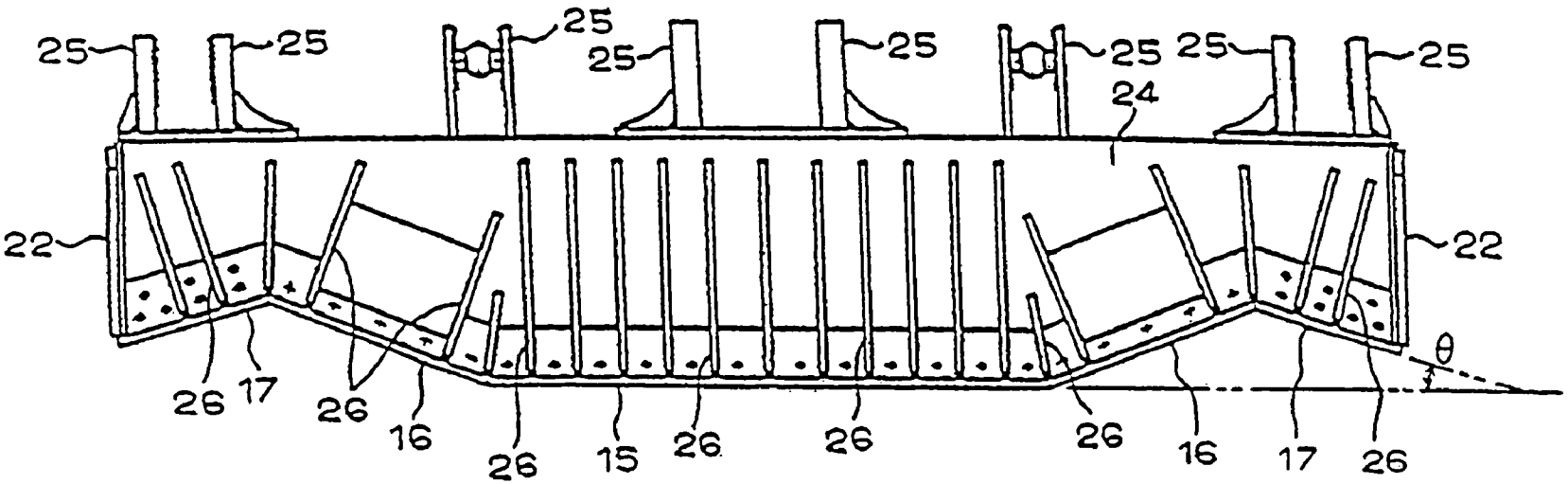
FIG. 7 is a bottom view of the blade.
Figure 8:
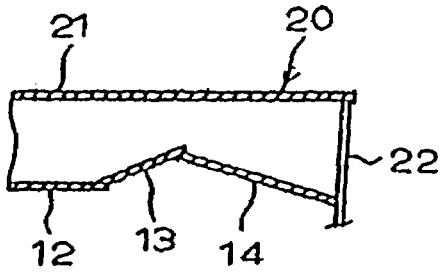
FIG. 8 is a sectional view taken along the line VIII-VIII of FIG. 2.
Figure 9:
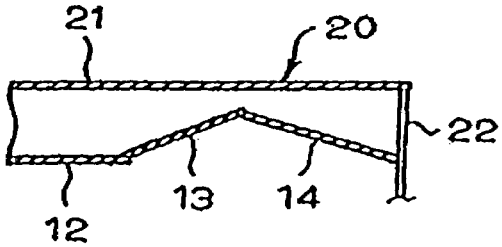
FIG. 9 is a sectional view taken along the line IX-IX of FIG. 2.
Figure 10:
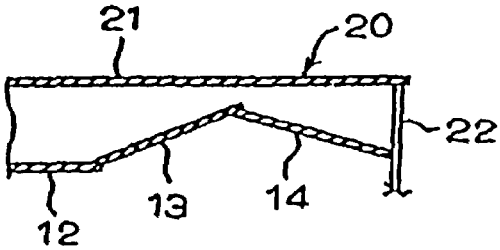
FIG. 10 is a sectional view taken along the line X-X of FIG. 2.
Figure 11:
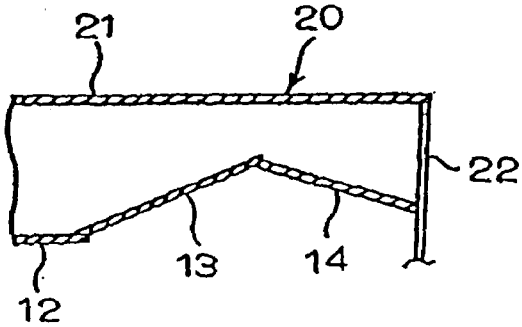
FIG. 11 is a sectional view taken along the line XI-XI of FIG. 2.
Figure 12:
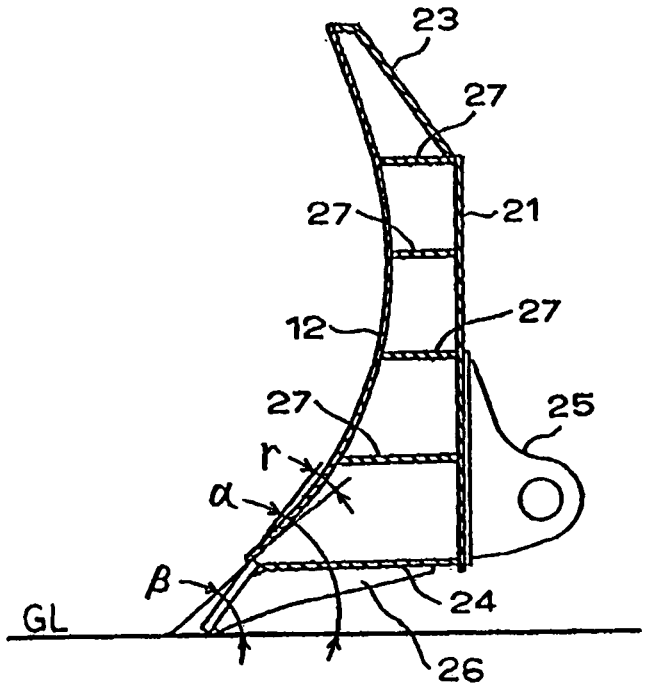
FIG. 12 is a sectional view taken along the line XII-XII of FIG. 6.
Figure 13:
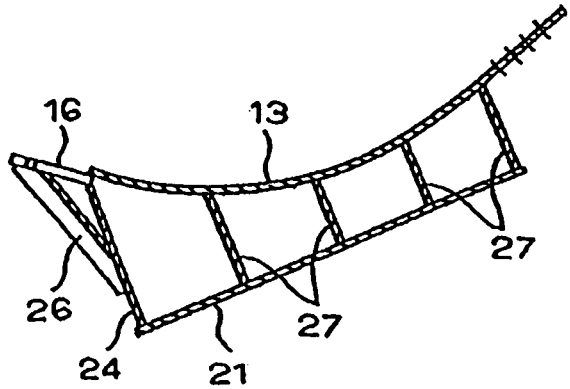
FIG. 13 is a sectional view taken along the line XIII-XIII of FIG. 5.
Figure 14:
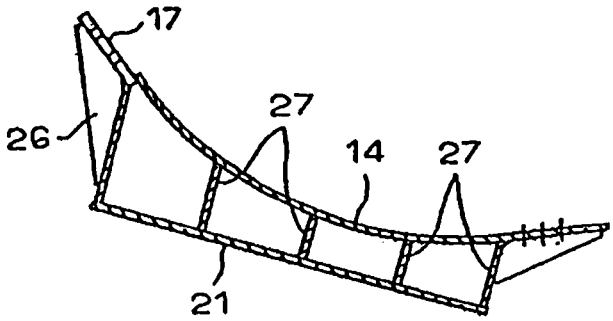
FIG. 14 is a sectional view taken along the line XIV-XIV of FIG. 5.

Plural vertical ribs 26, . . . 26 are extended in a back and forth directions at each position corresponding to the respective cutting edges 15 to 17 of the lower plate 24 of the supporting body 20 as shown in FIGS. 6 and 7 in order to reinforce the respective cutting edges 15 to 17. Front ends of the respective vertical ribs 26, . . . 26 are screwed to rear faces of the cutting edges 15 to 17. As shown in FIGS. 12 to 14, four reinforcement plates 27, . . . 27 are disposed within the supporting body 20 horizontally in a length direction with a predetermined gap in the vertical direction. A front end of each of the reinforcement plates 27 has a shape meeting a rear face shape of the blade front face section 11. This reinforcement plates 27 are welded to inner faces of the rear face plate 21 and side face plate 22 of the supporting body 20 and the rear face of the blade front face section 11 so that they are integrated.

Each of the side plate 22 of the supporting body 20 is disposed such that it exceeds a side edge of the end front face section 14. This side plate 22 has a function of reinforcing the end front face section 14. This supporting body 20 is capable of intensifying strength and stiffness, so that the end front face section 14 can exert the function of holding soil being dug or carried securely with a simple structure. Although, according to this embodiment, the central front face section 12, the jointed front face section 13 and the end front face section 14 are formed of a plate material and integrated by welding, these front face sections 12 to 14 may be cast integrally.

The blade width W1 of the central front face section 12, the blade width W2 of the jointed front face section 13 and the blade width W3 of the end front face section 14 are in a relation of W3<W2<W1. Setting the relation in dimension enables an effective digging force of the second cutting edge 16 of the jointed front face section 13 and the third cutting edge 17 of the end front face section 14 to be smaller than that of the first cutting edge 15 of the central front face section 12. Consequently, the quantity of soil loaded along the front face of each blade of the jointed front face section 13 and end front face section 14 is reduced thereby decreasing resistance of soil to the central front face section 12.

If the blade width W2 of the jointed front face section 13 is smaller than the blade width W3 of the end front face section 14, the flow of soil being moved from both the central front face section 12 and end front face section 14 during digging/carrying of soil is disturbed. As a result, the resistance of soil being flown from the end front face section 14 into the jointed front face section 13 is increased thereby restricting involving of soil deposited on the blade front face of the central front face section 12, which is a fault to be solved. However, according to the invention, the blade width W2 of the bottom end of each of the jointed front face sections 12 and the blade width W3 of the bottom end of each of the end front face sections 14 are determined depending on a bending angle of the jointed front face sections 13 with respect to the central front face section 12 and an intersection angle of an extension of the first cutting edge 15 of the central front face section 12 and an extension of the third cutting edge 17 of the end front face section 14. Thus, an above-mentioned relation can not be always realized.

An intersection angle θ shown in FIG. 7 between extensions of the cutting edges 15, 17 of the central front face section 12 and end front face section 14 is set to 16°. If this intersection angle θ is set to 25° or more, the resistance of soil moved from the end front face section 14 to the jointed front face section 13 is decreased, so that natural swelling exceeding an angle of repose along the blade front face of each of the front face sections 12 to 14 or embracing condition cannot be obtained. Thus, the intersection angle θ is preferred to be set to 25° or less and at this angle, an optimum quantity of soil to be loaded on each blade front face of the jointed front face section 13 and end front face section 14 can be secured. The intersection angle θ is preferred to be set in a range of 10 to 20°.

On the front face section, at least, the blade front face of the central front face section 12 is preferred to be inclined backward more than the front face of the first cutting edge 15. In this indicated example, a sweepback angle γ which is a difference between an angle (tip angle) β made by the front face of the first cutting edge 15 and the ground and an angle (cutting angle) α made by a blade bottom face of the central front face section 12 and the ground is set to 10° as shown in FIG. 12. This sweepback angle γ is preferred to be 15° or less and at this angle, falling of soil backward of the respective front faces 12 to 14 during digging/carrying of soil can be reduced. According to the invention, it is permissible to set the sweepback angle γ at 0°, that is, it is permissible to conform the cutting angle α to the tip angle β without changing the cutting angle α. In this case, however, some kind of improvements should be added to the blade because a reduction of the deposited soil during digging would be expected.

By the way, the respective blade front faces of the central front face section 12, the jointed front face section 13 and the end front face section 14 are continuously curved faces in upward and downward directions which are concave faces as described previously and as shown in FIGS. 1, and 12 to 14. The blade front faces of the respective front face sections 12 to 14 are preferred to be formed into a curved faces which do not restrict the quantity of embraced soil and swelling height and provide a concave curved face having the same curvature. In the indicated example, the respective blade front faces of the jointed front face section 13 and end front face section 14 have the same curvature.

Figure 15:
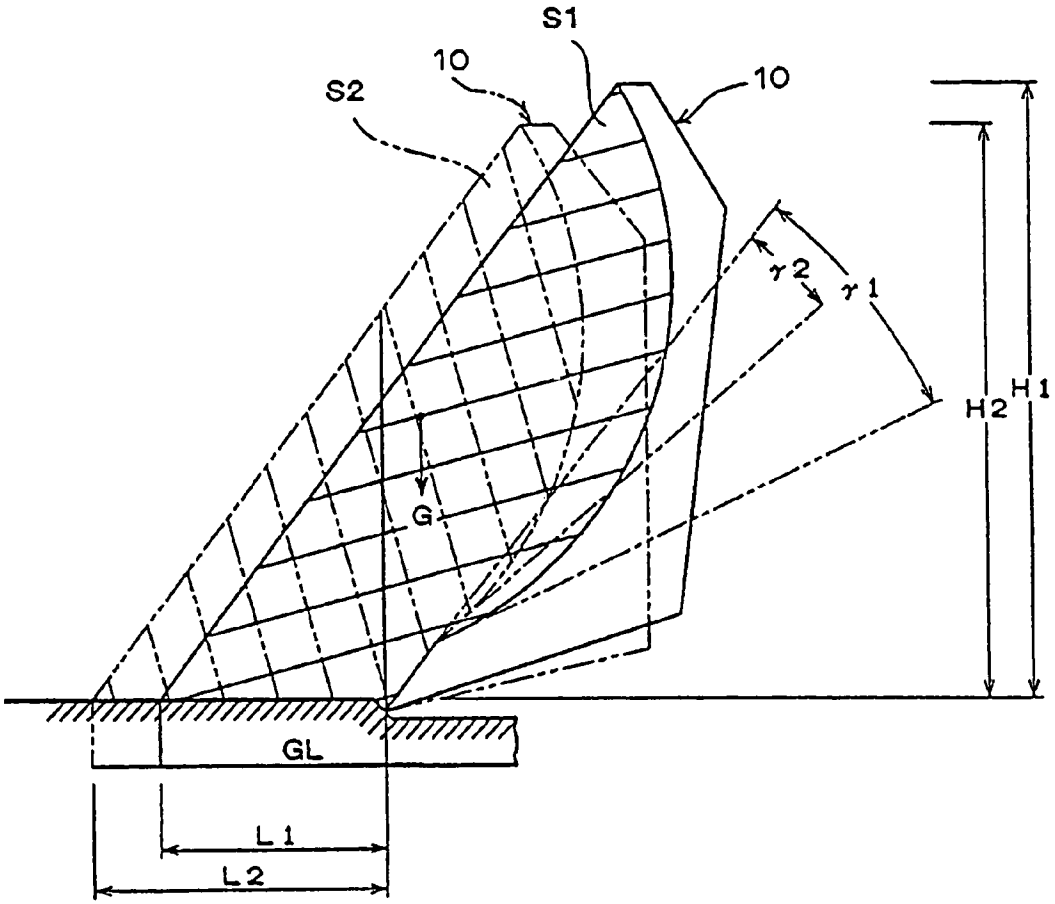
FIG. 15 is an explanatory diagram showing a relation between a blade in a normal posture and a rearward inclined posture at the time of digging and carrying of soil and soil deposited forward.

FIG. 15 is an explanatory diagram schematically showing changes in sliding resistance between the blade and soil deposited on the ground forward of the blade depending on the blade posture. In the same figure, a solid line indicates a soil carrying posture of the blade 10 of the invention while a phantom line indicates a soil carrying posture of an ordinary blade. Here, it is assumed that front curved faces of both blades are equal and their cutting angles α are fixed.

To decrease the sliding resistance between soil deposited on the ground surface forward of the blade and the ground at the time of carrying of soil, the quantity of soil deposited on the ground should be reduced. As indicated by the solid line and phantom line in FIG. 15, an inclination angle (angle of repose) of the front face of deposited soil when carried by the blade is constant. Then, to reduce the quantity of soil deposited on the ground, the front end of soil deposited on the ground surface needs to be approached to the tip of the blade 10 as much as possible such that the distance between the blade tip and the front end of the deposited soil is changed from L2 to L1 and an area hatched with leftward declining phantom lines indicated in the same figure is changed from S2 to S1 represented with a solid line.

However, if it is intended to approach the front end of the soil deposited on the ground to the blade tip, if the cutting angle α and the sweepback angle γ are constant, the blade height is necessarily decreased because the front face of the soil deposited on the ground surface is always at the same inclination angle, so that the quantity of embraced soil on the blade is also decreased. To keep the same embracing amount as an ordinary case, the areas S1, S2 hatched with solid lines and rightward rising phantom lines need to be equal because the blade width is constant.

As a result, to secure the same quantities of dug soil and carried soil as the ordinary case while decreasing the resistance to soil being carried, the blade 10 is inclined backward by adjusting the tip angle β without changing the cutting angle α as shown with a solid line in FIGS. 12 and 15 and further, blade height is increased. That is, by securing a sweepback angle γ1 which is larger than the ordinary sweepback angle γ2 as a sweepback angle γ which is a difference in angle between the cutting angle α and the tip angle β, the blade 10 can be inclined backward. However, if the sweepback angle γ is increased too much, not only falling of soil backward of the blade is increased as described previously, but also the deposited soil becomes unlikely to fall down from the blade at the time of discharge. Thus, the value of this sweepback angle γ is preferred to be 15° or less.

According to this embodiment, the sweepback angle γ is 10°, and with respect to ordinary ground contact length of deposited soil L2 on the ground surface forward of the blade tip, the ground contact length L1 of the deposited soil on the blade 10 of this embodiment is decreased by about 10%, so that the quantity of soil deposited on the ground surface is decreased. On the other hand, the deposited soil in front of the front face sections 12 to 14 can be carried on the front face of each blade in a large quantity at the time of digging/carrying of soil, the so-called embracing amount is increased. Consequently, the resistance to soil being carried can be reduced largely, so that the consumption horsepower per tractional force can be reduced largely thereby obtaining an excellent low-fuel consumption performance.

Further, because a large quantity of soil can be loaded on the front face of the blade front face section 11 as described above, an excellent balance on ground contact pressure between the front and rear sections of the vehicle body is obtained and further, power loss such as track shoe slip is minimized, thereby a high tractional force being obtained. Moreover, soil deposited on the blade front face of the blade front face section 11 can be prevented from falling beyond the top end of each of the front face sections 12 to 14. No dug soil makes a firm contact with the blade front face, so that release of soil at the time of discharge is improved, thereby the soil discharge performance being intensified. The blade tip angle β made by the front face and the ground when the respective cutting edges 15 to 17 exist on the ground surface is preferred to be 35° or more. Consequently, the minimum digging/carrying energy amount and the maximum quantity of soil are obtained.

Hereinafter, a specific embodiment of the invention will be described with a comparative example.

A model scaled at 1/15 the actual size of the blade 10 of the invention having the above-described configuration was produced and experimented as follows. Width of the model blade (hereinafter referred to as model blade of the invention) was set to 271 mm, blade height was set to 124 mm and blade capacity was set to 4427 $cm^3$. With blade cutting depth of 10 mm, the cutting angle α of 52° and traveling velocity at a constant one of 35 mm/second as a measuring condition, the model blade of the invention was pulled in sand having water containing ratio of 7.8%. Then, stresses of the cutting edge and blade stay were measured using a load measuring stress gauge.

Figure 17:
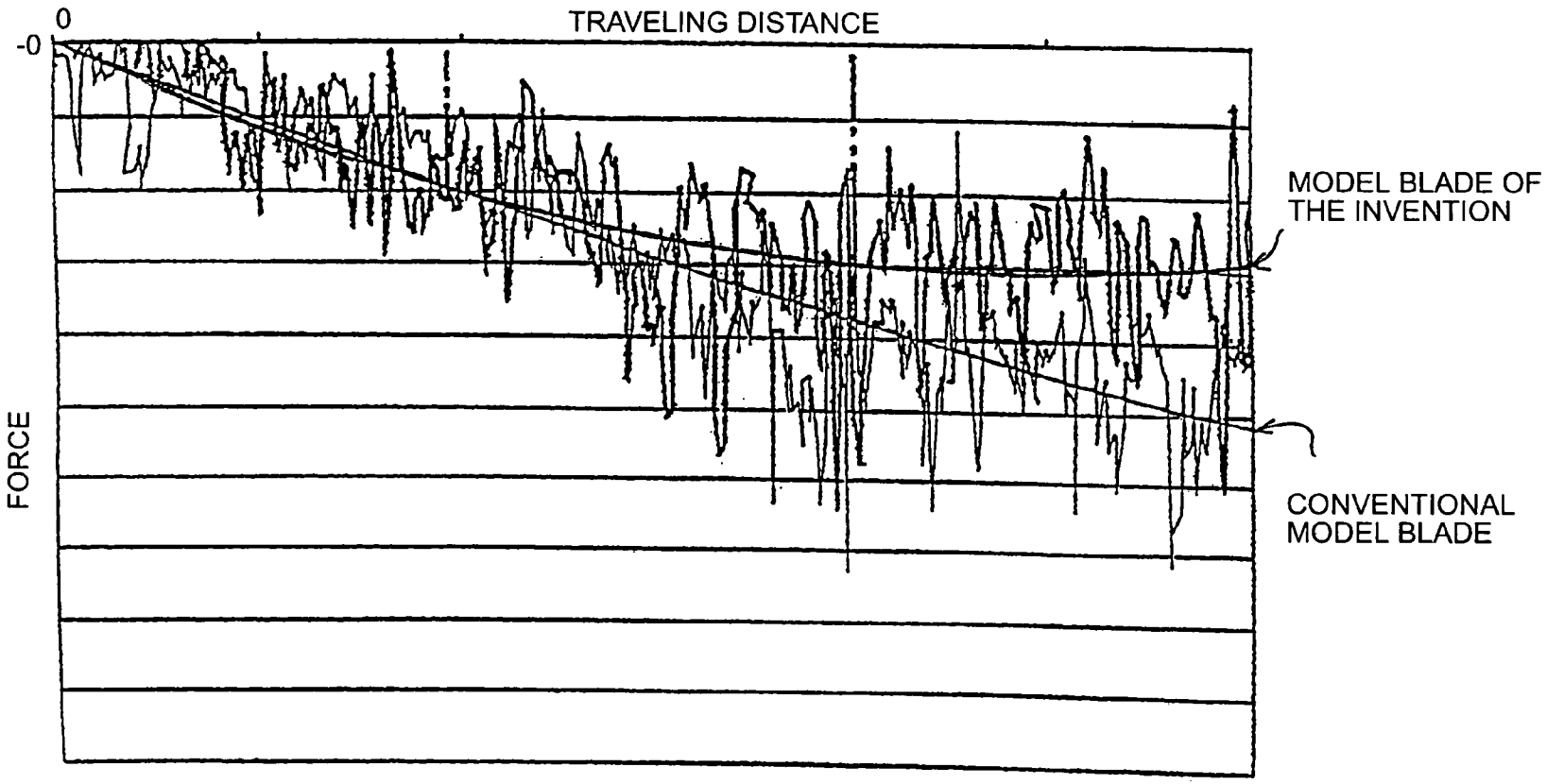
FIG. 17 is a graph showing an example of changes in load with respect to a traveling distance of a blade, comparing loads acting on both right and left end sections of the blade model of the invention with a load acting on both the right and left end section of the conventional blade model.
Figure 18A:
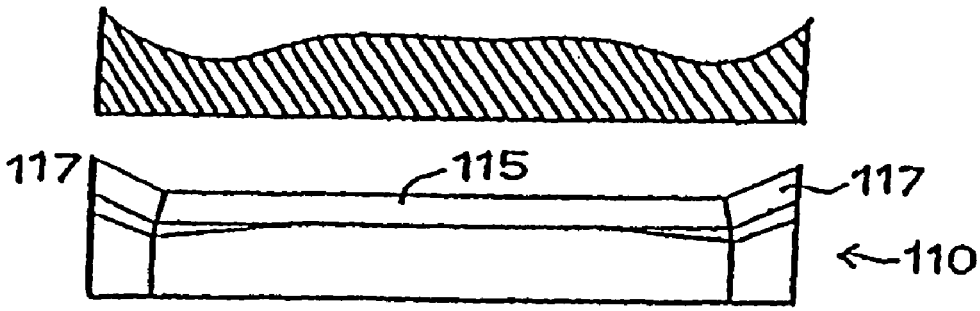
FIG. 18A PRIOR ART
FIG. 18 is an explanatory diagram for explaining an example of a product of loads of the blade model of the invention and the conventional blade model.

On the other hand, in the model of a conventional blade, as shown in FIG. 18(A), which is so-called semi-U blade 110, right and left end sections of a central front face section are disposed such that they are inclined forward and cutting edges 117, 117 of the right and left end sections are protruded forward relative to a cutting edge 115 of the central front face section. Blade width, blade height and blade capacity of this model blade (hereinafter referred to as a conventional model blade) were set equal to those of the model blade of the invention and results were measured under the same condition as the model blade of the invention. The results are shown in FIGS. 16 to 21.

Figure 16:
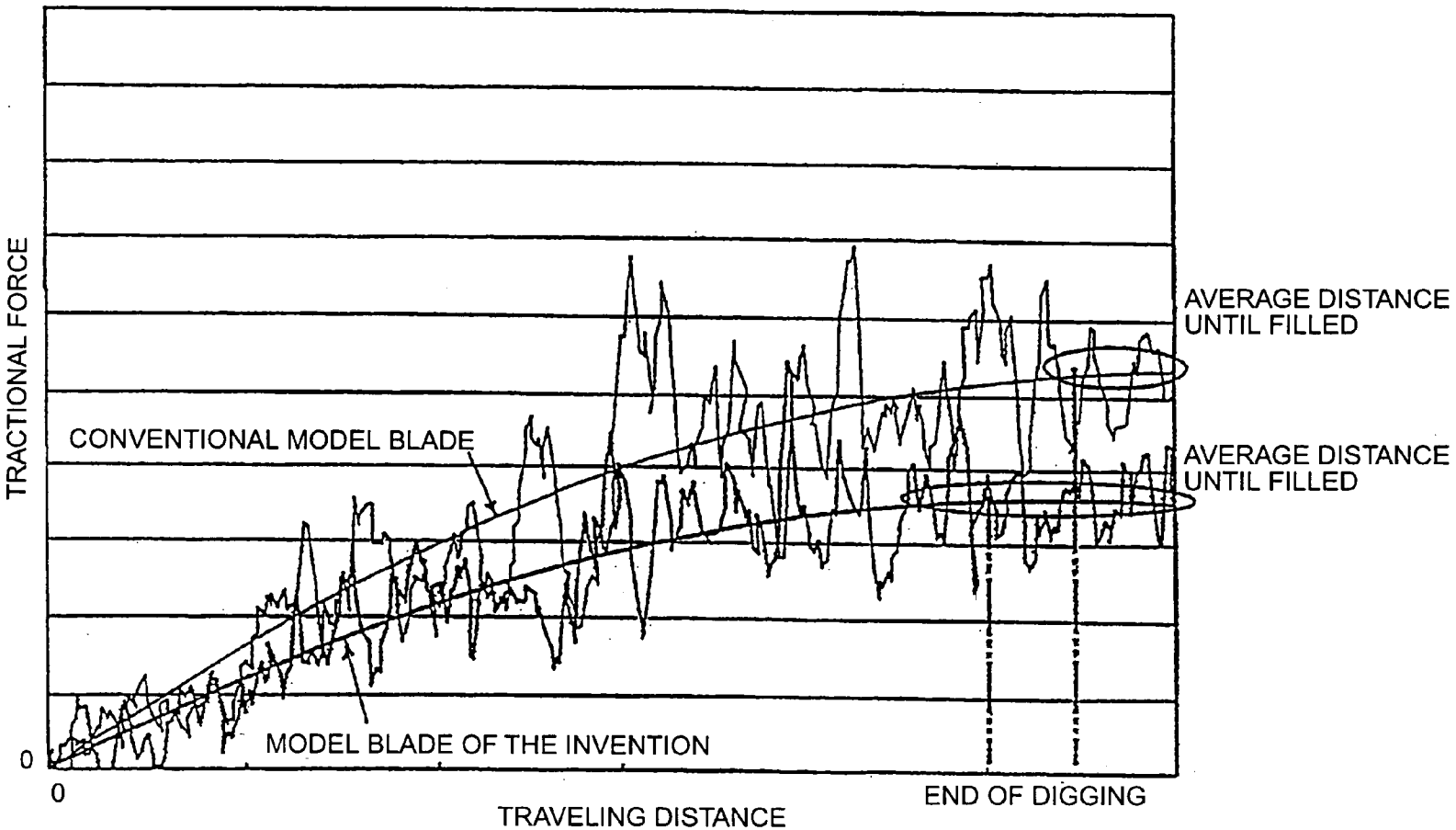
FIG. 16 is a graph showing an example of changes in a tractional force with respect to a traveling distance of a blade, comparing a blade model of the invention with a conventional blade model.

FIG. 16 is a graph showing an example of changes in tractional force with respect to a traveling distance of the blade under the same digging condition, comparing the model blade of the invention with the conventional model blade. A wave indicated by a thick solid line in the graph indicates changes in tractional force of the model blade of the invention while a parabola indicated with a thick solid line indicates an average of the tractional force. A parabola indicated with a thin solid line on the graph indicates an average of the tractional force.

As evident from the figure, the tractional force of the model blade of the invention increases gradually by smaller force than the conventional model blade as the traveling distance increases. A distance until the model blade of the invention is filled with soil (section indicated with a two-dot and dash line in the same figure) is shorter than the conventional model blade. In other words, the blade of the invention can obtain the same digging force with a smaller tractional force and shorter traveling distance than the conventional blade.

FIG. 17 is a graph showing an example of changes in force with respect to a blade traveling distance, comparing a force applied to right and left end sections of the model blade of the invention with a force applied to the right and left end sections of the conventional model blade. Its ordinate axis indicates a force applied to the blade with its moving direction as plus, according to which its absolute value increases, a larger load is applied to the right and left end sections of the blade. An abscissa axis indicates a traveling distance of the blade under a predetermined digging condition. A wave represented by a thick solid line in the graph indicates changes in force applied to the right and left end sections of the model blade of the invention and a parabola represented by a thick solid line indicates an average of that force. A wave represented by a thin solid line on the graph indicates changes in force applied to the right and left end sections of the conventional model blade and a parabola represented by a thin solid line indicates an average of the force. Generally, the load which the right and left end sections receive increases with a progress of the traveling distance until an inside of the blade is filled with soil, that is, its soil carrying capacity is saturated.

As evident from the figure, the model blade of the invention is moved over a short distance (a portion indicated with a dot and dash line in the figure) because the right and left end sections of the blade receive substantially the same load as the conventional model blade. If the distance is exceeded, load acting on the right and left end sections of the blade increases more mildly than the conventional model blade, and if the distance indicated by two-dot and dash line in the figure is exceeded, it remains substantially constant. On the other hand, because the load increases within the traveling distance indicated in the figure in case of the conventional model blade, it is recognized that digging has not been finished. That is, in case of the blade of the invention, its traveling distance is shorter than the conventional blade with respect to a similar level digging and when the digging is progressed to some extent, a load received by the right and left end sections (so-called blade tip) is small.

Figure 18B:
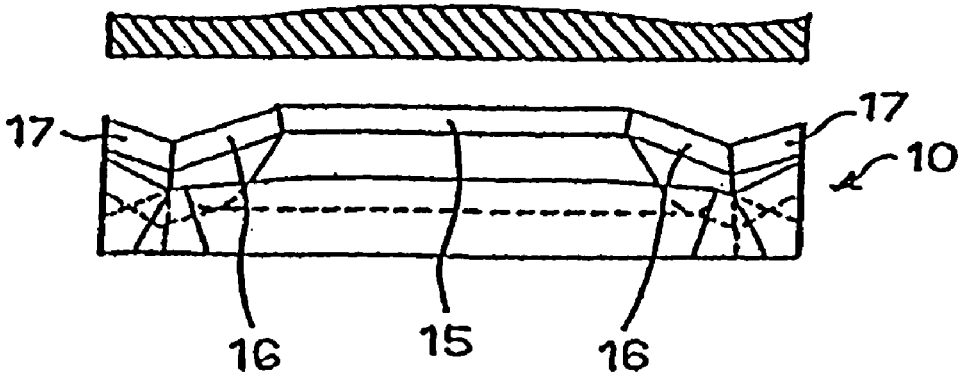

If referring to FIG. 18, FIG. 18(A) shows an example of load product of the conventional model blade and FIG. 18(B) shows an example of load product of the model blade of the invention. In FIG. 18(B), reference numerals are attached to the substantially same components as those of the blade 10 of the above-described embodiment.

As evident from these figures, the model blade 10 of the invention relaxes load acting on the second and third cutting edges 16, 17 located at both of the right and left end sections of the central front face section 12, so that a small tractional force is applied substantially equally over the first cutting edge 15 of the central front face section 12 to the second and third cutting edges 16, 17 while a blade tip force is applied effectively to the respective cutting edges 15 to 17.

On the other hand, the conventional blade 10 requires an excessive load to acquire the maximum quantity of soil. Further, because load acting on the cutting edges 117 of the right and left end sections of the conventional blade 110 is applied in concentration, the cutting edge 115 of the central front face section of the blade 110 cannot be operated effectively for cutting out soil.

Figure 19:
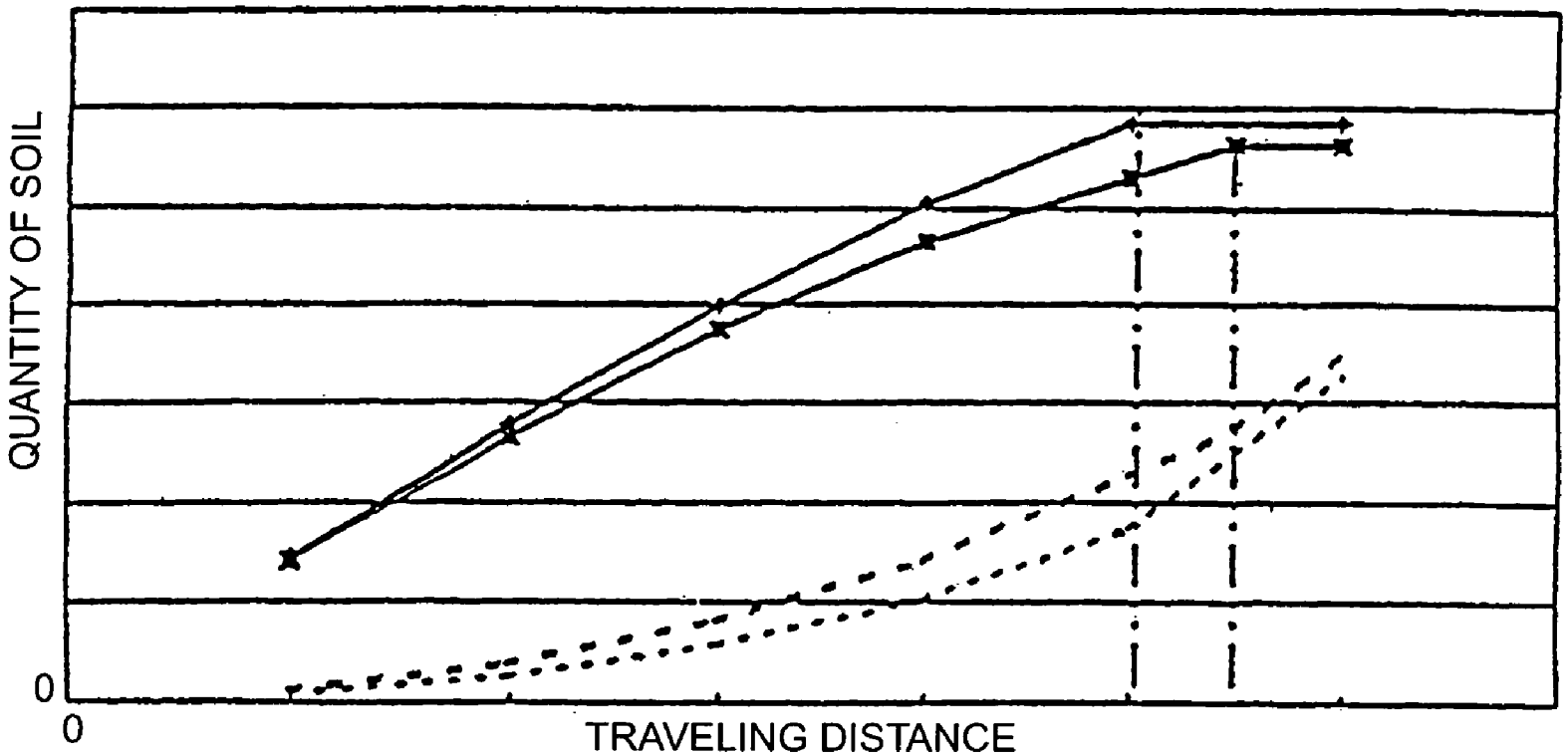
FIG. 19 is a graph showing an example of changes in the amount of soil with respect to the traveling distance of a blade comparing the blade model of the invention with the conventional blade model.

FIG. 19 is a graph showing changes in the quantity of soil with respect to the traveling distance of the blade, comparing the model blade of the invention with the conventional model blade. The changes in change of the quantity of soil carried by the model blade of the invention and the conventional model blade are plotted with ♦ and ■ respectively on the graph and changes in the quantity of falling soil (windrow) from the blade side faces are indicated by a thick dotted line and a thin dotted line.

As evident from the figure, it is understood that in case of the model blade of the invention, the quantity of falling soil from digging start to an end thereof is smaller than that of the conventional model blade. As a result, it is understood that the quantity of soil obtained by the model blade of the invention when it is full (a portion indicated by a two-dot and dash line in the figure) is increased by about 4% as compared to the conventional model blade within the same time interval.

Figure 20B:
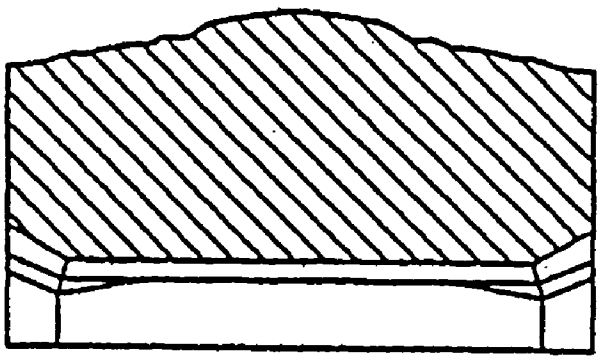
FIG. 20B PRIOR ART
FIG. 20 is an explanatory diagram showing an example of a shape of soil and sand in the conventional blade model.
Figure 20A:
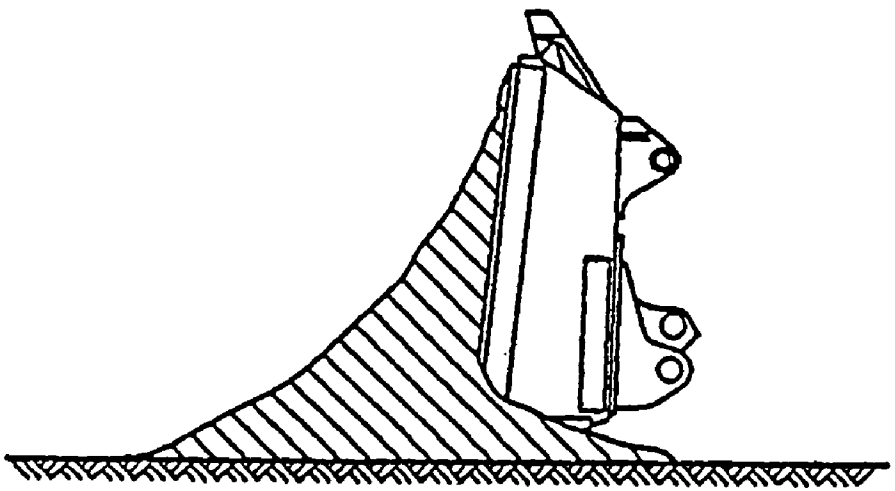
FIG. 20A PRIOR ART
Figure 21B:
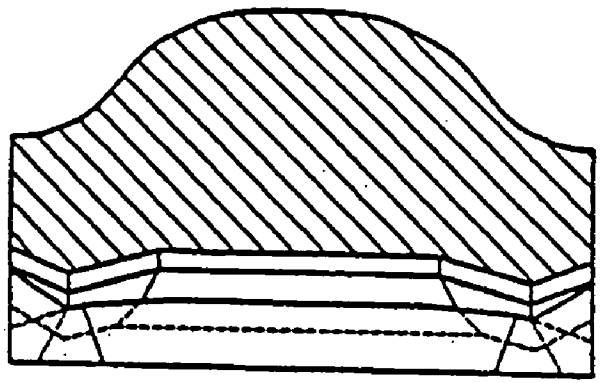
FIG. 21 is an explanatory diagram showing an example of a shape of soil and sand in the blade model of the invention.
Figure 21A:
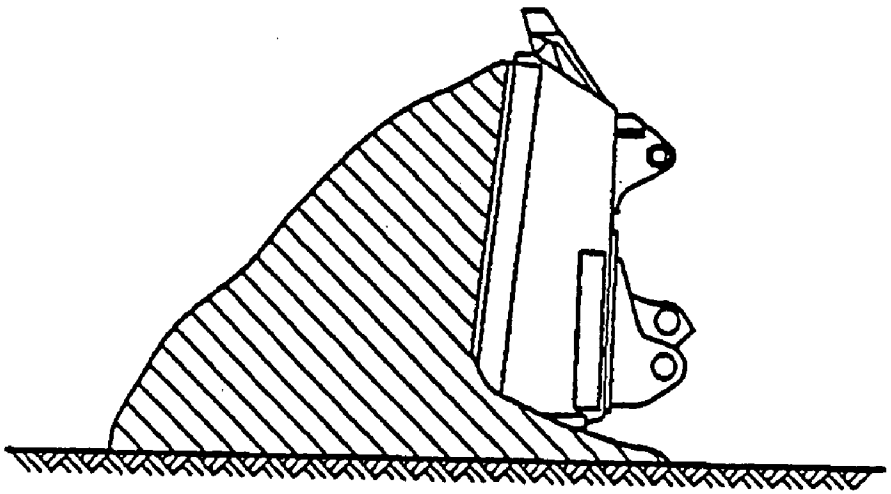

If referring to FIGS. 20 and 21, FIGS. 20(A) and 20(B) show examples of shapes of deposited soil by the conventional model blade and FIGS. 21(A) and 21(B) show examples of shapes of deposited soil by the model blade of the invention.

As evident from these figures, it is understood that the quantity of soil deposited forward of the right and left end sections of the model blade 10 of the invention is smaller than that of the conventional model blade. Further, as for the quantity of soil deposited forward of the conventional model blade 110, as shown in FIGS. 20(A) and 20(B), the soil is deposited entirely along the width of the blade substantially linearly. Contrary to this, as for the quantity of soil deposited forward of the model blade 10 of the invention, as shown in FIGS. 21(A) and 21(B), it is understood that soil is deposited such that it is swollen in a mountain-like shape exceeding the angle of repose from both of the right and left end sections of the same blade 10 toward the central portion and at the same time, from the top of the blade to the bottom. From the above described points, it is understood that the blade 10 of the invention can increase the quantity of soil deposited forward of the blade largely by reducing the falling soil.

From data obtained from results of the above experiment, if an actual machine is used, the quantity of soil deposited forward when the blade of the invention is in carrying posture is increased as compared to the conventional blade. The reason is that because as described above, the sweepback angle $\gamma$ of the blade front face section 11 is set to 15° or less so that the blade 10 is inclined backward, soil deposited forward of the blade 10 can be carried on the blade front face in a large quantity during digging/carrying and further, by reducing the ground contact length of soil deposited on the ground to L1, the digging resistance and soil carrying resistance can be reduced.

In addition, the tractional force by the blade of the invention and the quantity of soil per tractional force are increased as compared to those of the conventional blade. The blade of the invention reduces digging resistance and soil carrying resistance with respect to the conventional blade. Thus, consumption horsepower at the time of digging/carrying of soil of the blade of the invention is decreased as compared to the consumption horsepower at the time of digging/carrying of soil in the conventional blade. From the above-described points, it is understood that the blade of the invention is capable of realizing a desired bulldozer operation with a small tractional force and digging force in a shorter time than the conventional working time.

As evident from the above description, the first cutting edge 15 of the blade 10 of the invention cuts soil and sand positively ahead of the second and third cutting edges 16, 17 because it is projected forward relative to the second and third cutting edges 16, 17. The substantial digging force of the second and third cutting edges 16, 17 becomes smaller than the digging force of the first cutting edge 15, so that a tractional force applied to the third cutting edge 17 is relaxed and the tractional force acts on the respective cutting edges 15 to 17 effectively. Therefore, resistance to the tractional force is reduced thereby increasing the quantity of soil carried per tractional force. Moreover, the consumption horsepower at the time of digging/carrying of soil can be reduced largely and at the same time, the maximum digging amount and carrying amount of soil can be obtained with the minimum energy in a short time. Consequently, the fuel consumption efficiency of the work machine is improved remarkably thereby achieving low cost.

What is claimed is:

1. A blade to be mounted on various kinds of work machines, the blade comprising:

a central front face section and end front face sections disposed at right and left end sections thereof via jointed front face sections, wherein a bottom end of each of the jointed front face sections and a bottom end of each of the end front face sections are disposed substantially backward relative to a bottom end of the central front face section when viewed from their tops, each blade front face of the central front face section, the jointed front face sections and the end front face sections is constructed of a continuously curved concave face from a top end toward a bottom end thereof, blade width of the blade front face of the central front face section gradually increases from the bottom end toward the top end thereof, and the bottom end of the central front face section is extended in right and left directions perpendicularly to a digging direction.

2. The blade for work machines according to claim 1, wherein the central front face section has a first cutting edge at the bottom end thereof, the jointed front face sections on right and left are disposed continuously to the central front face section so as to expand backward with a predetermined angle when viewed from their tops, and have second cutting edges on their bottom ends, the end front face sections on right and left are disposed continuously to the jointed front face sections so as to expand forward with a predetermined angle when viewed from their tops, and have third cutting edges on their bottom ends, and intersection points where the second cutting edges and the third cutting edges intersect are disposed backward with respect to a end of the first cutting edge when viewed from their tops.

3. The blade according to claim 2, wherein the second cutting edges and the third cutting edges are continuous in a V shape or U shape.

4. The blade according to claim 2, wherein the second cutting edges are disposed so as to slightly incline downward with respect to the first cutting edge in right and left directions and the third cutting edges are disposed so as to slightly incline upward with respect to the second cutting edges in right and left directions.

5. The blade according to any one of claims 1 and 2, wherein a lowest point of an end of either each of the second cutting edges or each of the third cutting edges is, or lowest points of both of them are disposed lower than the end of the first cutting edge in a front view when the blade is set on a ground.

6. The blade according to any one of claims 1 and 2, wherein respective blade front faces of the central front face section, the jointed front face sections and the end front face sections are inclined equally or backward with respect to front faces of respective cutting edges.

7. The blade according to claim 6, wherein sweepback angles of the respective cutting edges of the central front face section, the jointed front face sections and the end front face sections are set within a range of 0° to 15°.

8. The blade according to claim 2, wherein a curved face of the central front face section is constructed of an arc face having a certain curvature.

9. The blade according to claim 8, wherein respective blade front faces of jointed front face sections and end front face sections are constructed of a curved face having a same curvature as that of the central front face section.

10. The blade according to any one of claim 2, wherein an intersection angle between extensions of the respective cutting edges of the central front face section and each of the end front face sections is set to 25° or less.

11. A construction and earth-moving machine provided with the blade according to any one of claims 1 and 2.

12. The blade for work machines according to claim 1, wherein blade width at the bottom end of the central front face section is larger than internal width between right and left traveling units.

13. The blade according to claim 1, wherein blade width at the bottom end of the central front face section is substantially equal to gauge width which is a distance between right and left traveling unit centers.

14. The blade according to claim 13, comprising a supporting body for supporting rear faces of a central front face section, jointed front face sections and end front face sections, wherein right and left side sections of the supporting body are extended in an digging direction beyond both right and left side edges of the end front face sections.

15. The blade according to claim 14, wherein blade width of the central front face section is set larger than a distance between opposing faces of right and left brackets for lift cylinders.

16. The blade according to claim 1, wherein the jointed front face sections and end front face sections are continuous in a V shape or U shape.

* * * * *